US005508078A

United States Patent [19]

Stalnaker

[11] Patent Number: 5,508,078

[45] Date of Patent: Apr. 16, 1996

[54] EDGE AND CORNER GUARD

[76] Inventor: Marc E. Stalnaker, 6 Pembrook Ct., Niceville, Fla. 32578-3931

[21] Appl. No.: 377,792

[22] Filed: Jan. 24, 1995

[51] Int. Cl.[6] ..... B32B 1/06

[52] U.S. Cl. ..... 428/71; 428/99; 428/100; 248/345.1; 52/287.1; 52/288.1

[58] Field of Search ..... 428/71, 74, 100, 428/99; 248/345.1; 52/287.1, 288.1

[56] References Cited

U.S. PATENT DOCUMENTS

| | | | |
|---|---|---|---|
| D. 309,777 | 8/1990 | Woods | D23/403 |
| D. 347,888 | 6/1994 | Jackson | D23/403 |
| 3,634,925 | 1/1972 | Van Loo | 29/458 |
| 4,304,824 | 12/1981 | Karpinski | 428/71 |
| 4,787,366 | 11/1988 | Bell | 126/500 |
| 4,817,902 | 4/1989 | Mason | 248/345.1 |
| 4,865,015 | 9/1989 | Hasty | 126/500 |
| 4,878,258 | 11/1989 | Casey | 428/44 |
| 4,903,686 | 2/1990 | Jennings | 126/500 |
| 4,922,891 | 5/1990 | King | 126/544 |
| 5,183,030 | 2/1993 | Woodward | 126/500 |

*Primary Examiner*—Alexander S. Thomas
*Attorney, Agent, or Firm*—Richard C. Litman

[57] ABSTRACT

A padded edge and corner guard includes a central core material which is sandwiched between two soft and resilient padding sheets of material (e.g., open or closed cell plastic foam, etc.), which sheets are in turn permanently or removably covered by an envelope of fabric or other suitable material. The central core is flexible and will hold any shape to which it is bent or formed, thus also holding the surrounding resilient padding sheets and cover in the desired shape to grasp an edge or corner to which the device is applied. The central core is preferably formed of a relatively soft metal with low yield strength and high fatigue resistance; non-woven poultry wire screen has been found to be particularly suitable. Two or more guards may also be joined end-to-end by securing mating attachment components together, as required, to cover the desired length.

15 Claims, 4 Drawing Sheets

EDGE AND CORNER GUARD

FIELD OF THE INVENTION

The present invention relates generally to relatively soft and compliant mats, pads, and the like used for covering a surface, and more specifically to a flexible edge and corner guard capable of retaining a shape into which it is bent or formed. The present edge and corner guard is thus adaptable to a multitude of different shapes of edges, corners, and the like, and serves to prevent injury or damage to persons or articles which may strike such an edge or corner covered by the present guard.

BACKGROUND OF THE INVENTION

In the typical family household with small children, at least minor injuries are relatively common due to the numerous relatively sharp and hard edges and corners which seem to abound in the average home. Aside from such obvious hazards as the hard corners and edges of a raised brick fireplace hearth, many articles of furniture (tables, counters, etc.) seem to have edges and corners which are positioned at about the height of the head of a small child. Most children are quite forgetful as to such hazards, particularly when playing, and at least minor injuries frequently occur due to such exposed corners and edges in the typical home.

Even a relatively cautious individual may incur injury when moving through a darkened room, or have cause to carry a large or bulky article which may be bumped inadvertently against a corner or edge during movement. The result is untold property damage and a multitude of at least minor injuries to numerous persons yearly.

Accordingly, a need will be seen for a padded edge and corner guard which is universally adaptable to various shapes of edges and corners found in the typical household, including, but not limited to, fireplace hearths, tables, and counters and the like. The guard must be flexibly conformable to any one of the above shapes as well as others, and must include means for holding the desired shade around the corner or edge to be covered once it has been bent to the appropriate shade. Moreover, means should be provided for securing at least two such guards together end to end, for longer edges, and for a relatively soft and padded cover over the guard, which cover may be removably secured to the guard therewithin as desired, for laundering or replacement.

DESCRIPTION OF THE PRIOR ART

U.S. Pat. No. 4,787,366 issued to Bobbi B. Bell on Nov. 29, 1988 discloses a Safety Device For A Hearth, comprising two layers of batting sandwiched between a cloth outer cover permanently sewn thereto. No stiffening means or means of holding a given shape is provided to the Bell covering; thus it is relatively flaccid and must be held in position with elastic bands and Velcro (tm). The present invention may also include hook and loop (e.g., Velcro, tm) attachment means for specialized uses, such as vertical outer edges of walls and the like. However, the present guard includes a flexible but conformable center component, which retains any given shape to which it is formed, thus serving to hold the present guard in position about most corners and edges without need for further securing means. In addition, the cover of the present guard may be made to be removable for cleaning and replacement, if desired.

U.S. Pat. No. 4,817,902 issued to Donald R. Mason on Apr. 4, 1989 discloses a Corner Protector And Cover directed only to guarding the corners of various objects. No flexible core material providing for the holding of a given shape, is disclosed; the shape is fixed by the molded foam materials used. The cover disclosed, covers only the outer surface and edges of the underlying corner protector, rather than enveloping the entire inner material, as in the present invention. No means is disclosed for securing multiple protectors together, nor is there any motivation for such, as the corners which may be covered by the Mason device are normally widely spaced. Multiple lengths of the present guard may be secured together end to end, for unbroken coverage of a long edge.

U.S. Pat. No. 4,865,015 issued to Kathy M. Hasty et al. on Sep. 12, 1989 discloses a Hearth Guard of a single thickness of batting sandwiched within a fabric cover. The cover includes longitudinal drawstring passages, with drawstrings to secure the device to a hearth; hooks or other anchors must be provided for securing the drawstrings. Hasty et al. require drawstring or other attachment means, as the relatively flaccid nature of the device cannot hold a given shape to which it is formed, as provided by the present invention; further the Hasty et al. cover is not removable.

U.S. Pat. No. 4,903,686 issued to Thad Jennings on Feb. 27, 1990 discloses an Outer Hearth Pad formed about what appears to be a rigid, fixed shape core, with a resilient pad thereover and a covering sheet overlying the pad. The opposite, hearth contact side of the core is uncovered, unlike the present guard. The core cannot be bent or shaped to conform to a variety of shapes, as provided by the present guard, even in Jennings' alternative pad formed of a single thickness of cast or molded resilient material.

U.S. Pat. No. 4,922,891 issued to Willella King on May 8, 1990 discloses a Hearth Concussion Barrier comprising a rigid wood frame with padding therearound and a vinyl cover over the front and top surfaces. The rigid wood frame is similar to the Jennings frame discussed above, and cannot be reconfigured to a different shape. The rigid material requires padding thereover, which adds further complexity to the device, in that the intent is to pad a hard edge, yet the first layer of material is a rigid, hard material. The vinyl (not cloth) cover cannot be removed and covers only the exposed outer surfaces, unlike the surrounding cover of the present guard. King provides connecting means for multiple lengths of the barrier, but the lengths abut end-to-end, rather than overlapping as in the present invention.

U.S. Pat. No. 5,183,030 issued to Keile J. Woodward on Feb. 2, 1993 discloses a Hearth Comforter comprising an internal sheet of batting enclosed in a fabric cover. The result is a relatively flaccid cover which cannot hold a given shape to which it is bent or formed, as provided by the core material of the present guard. Consequently, the Woodward comforter must be carefully sized and shaped to match exactly the dimensions of the hearth to which it is to be applied, as larger shapes will not grip the hearth, and smaller shapes will not fit around the corners and edges of the hearth. Moreover, the Woodward cover is not removable, as provided in the present invention.

U.S. Pat. No. D-309,777 issued to Kristy M. Woods on Aug. 7, 1990 discloses a design for a Fireplace Bumper Pad. No internal structure is disclosed, but the device apparently consists of several flat, rigid sheets tied together, with rectangular pads thereon. No conformability to other shapes is disclosed.

Finally, U.S. Pat. No. D-347,888 issued to Anita M. Jackson on Jun. 14, 1994 discloses a design for a Fireplace Hearth Cover. As in the Woods design above, no disclosure of the internal structure is provided. Only one specific size and shape is disclosed, with no means indicated for reconfiguring the cover to conform to other shapes and sizes of hearths or other corners and edges, as provided by the present edge and corner guard.

None of the above noted patents, taken either singly or in combination, are seen to disclose the specific arrangement of concepts disclosed by the present invention.

SUMMARY OF THE INVENTION

By the present invention, an improved edge and corner guard is disclosed.

Accordingly, one of the objects of the present invention is to provide an improved edge and corner guard which includes a flexible central core which retains the shape to which it is formed, thus providing for the present guard to be reshaped as desired to conform and secure to a variety of differently configured objects.

Another of the objects of the present invention is to provide an improved edge and corner guard which includes resilient padding on both sides of the central core material, and which further includes an envelope of fabric material therearound.

Yet another of the objects of the present invention is to provide an improved edge and corner guard which fabric envelope may be quilted as desired, and may be removably or permanently secured to the underlying resilient padding.

Still, another of the objects of the present invention is to provide an improved edge and corner guard which may include overlapping means providing for the series attachment of plural guards together, end to end.

A further object of the present invention is to provide an improved edge and corner guard which may be adapted to secure to vertical edges and the like by means of cooperating attachment means secured to the edge to be guarded, if desired.

A final object of the present invention is to provide an improved edge and corner guard for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 1 is an environmental perspective view of the present edge and corner guard, showing its application to an existing counter edge or the like.

Similar reference characters denote corresponding features consistently throughout the several figures of the attached drawings.

DETAILED DESCRIPTION OF THE PREFERRED EMBODIMENTS

Figure 1:
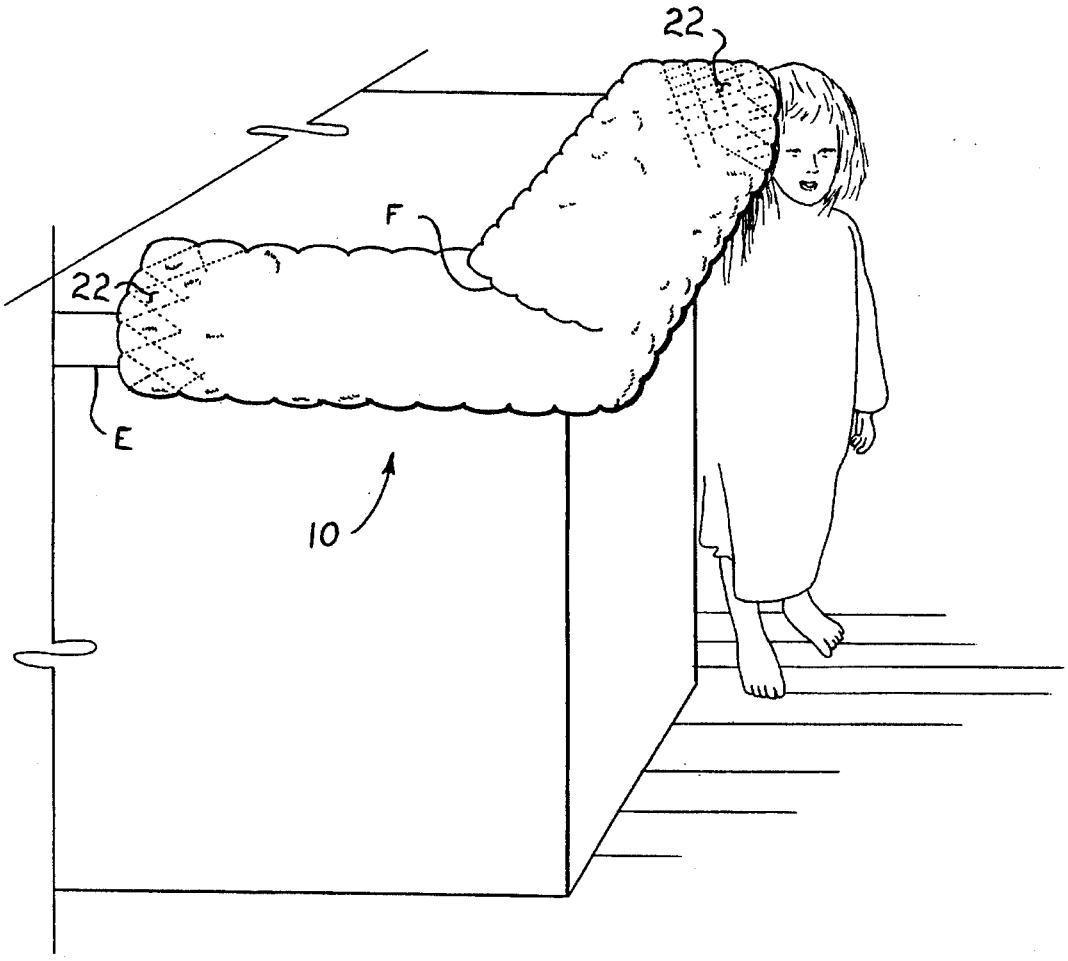
Figure 3:
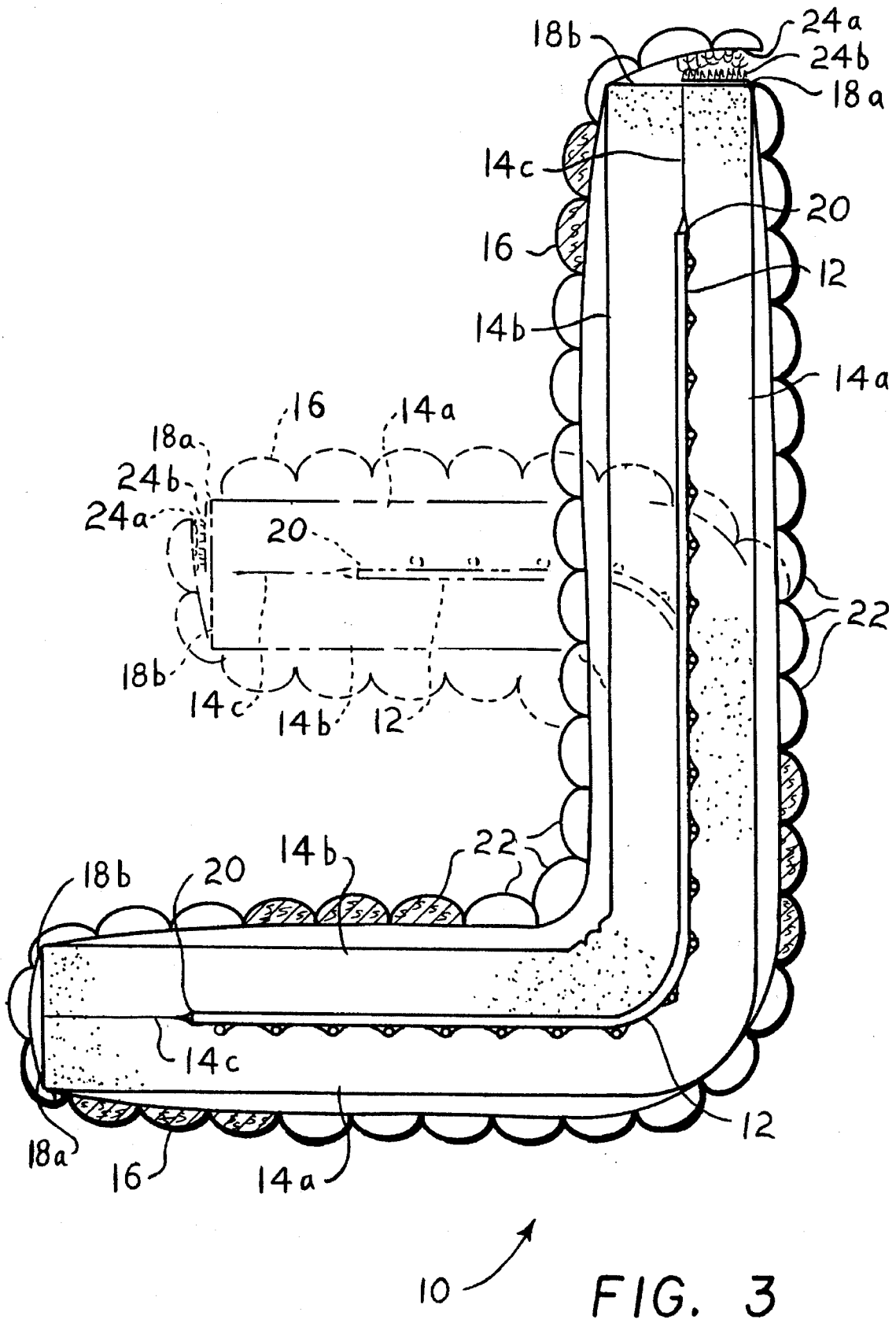
FIG. 3 is a side view in section of the present edge and corner guard showing its construction and internal components.

Referring now particularly to FIGS. 1 and 3 of the drawings, the present invention will be seen to relate to an edge and corner guard 10 which may be shaped and configured to fit closely about any practicable corner or edge, and which retains its shape to grasp the corner or edge therein and thereby to hold its installed position on the edge or corner. In FIG. 1, the present edge and corner guard 10 is shown in an installed position about a countertop edge E, to provide a soft and resilient padded surface therefor. The present edge and corner guard 10 is foldable, so that a corner may be formed by providing a diagonal or other corner fold F, as shown in FIG. 1.

FIG. 3 discloses details of the construction of the present edge and corner guard 10. A central core of material is sandwiched between two pads or sheets of soft and resilient material 14*a* and 14*b*, with an envelope 16 surrounding the central core 12 and the resilient sheets 14*a* and 14*b*. The central core 12 is formed of a material which is relatively "dead," i. e., non-resilient and having little or no tendency to spring back to a previous shape when it is bent or folded. A relatively soft metal having a relatively low strength and very high fatigue resistance has been found quite suitable for the core material 12, as it is desired that the material 12 may be flexed and folded innumerable times during its life in order to conform to various different shapes of edge and corner configurations.

It has been found that certain wire mesh or screen materials are quite suitable for the above use, particularly the screen or mesh material known as "poultry wire." This material is formed of a grid of longitudinal and lateral wires at right angles to one another, with the wires in one direction completely overlying the wires in the orthogonal direction; i. e., the groups of wires comprising the two directions are not interwoven with one another. Such wire is generally formed of soft iron or other suitable highly malleable and formable metal which tends to take a "set" at whatever position to which it is formed, and which also has a very high fatigue resistance, enabling the material to be bent and formed innumerable times without breakage.

The two padding sheets 14*a* and 14*b* which sandwich the core 12 therebetween are preferably formed of a soft and resilient synthetic foam material, in order to provide the desired resilience or "give" to the present edge and corner guard 10 when it is struck. Open or closed cell foams may be used, with closed cell foams providing somewhat more resilience and resistance to collapse, due to the captured gas bubbles therewithin. Preferably, the two resilient padding sheets 14*a*/14*b* are cut to a size somewhat larger than that of the central core 12, in order that the hard and relatively sharp edge of the relatively thin central core 12 is well covered. The larger or wider peripheral edges 18*a* and 18*b* of the flexible and resilient padding sheets 14*a* and 14*b* will be seen in FIG. 3 to extend well beyond the edge or periphery 20 of the central core material 12 in FIG. 3, with the core 12 placed centrally between the padding sheets 14*a*/14*b*. Preferably, the padding sheets 14*a*/14*b* are of equal size and have common, congruent peripheries 18*a*/18*b*, to provide a uniform shape for the guard 10.

The padding sheets 14*a*/14*b* may be secured to the central core material 12, and to one another along their mutual peripheries and through any screen mesh openings therein, by means of adhesive (as shown along the adhesive joint line 14*c* between the two sheets 14*a* and 14*b* in FIG. 3), or alternatively secured together as desired (e.g. stitching through the screen mesh of the central core, etc.).

The surrounding envelope or cover 16 is preferably formed of an attractive or decorative fabric material, which material may be quilted if desired, as indicated by the quilting pattern 22 of the various drawing figures. The cover 16 may be formed of a natural or synthetic fabric, and may be treated with a fire retardant chemical or other means if the present edge and corner guard is to be used in an area near a heat source or open flame.

Figure 2:
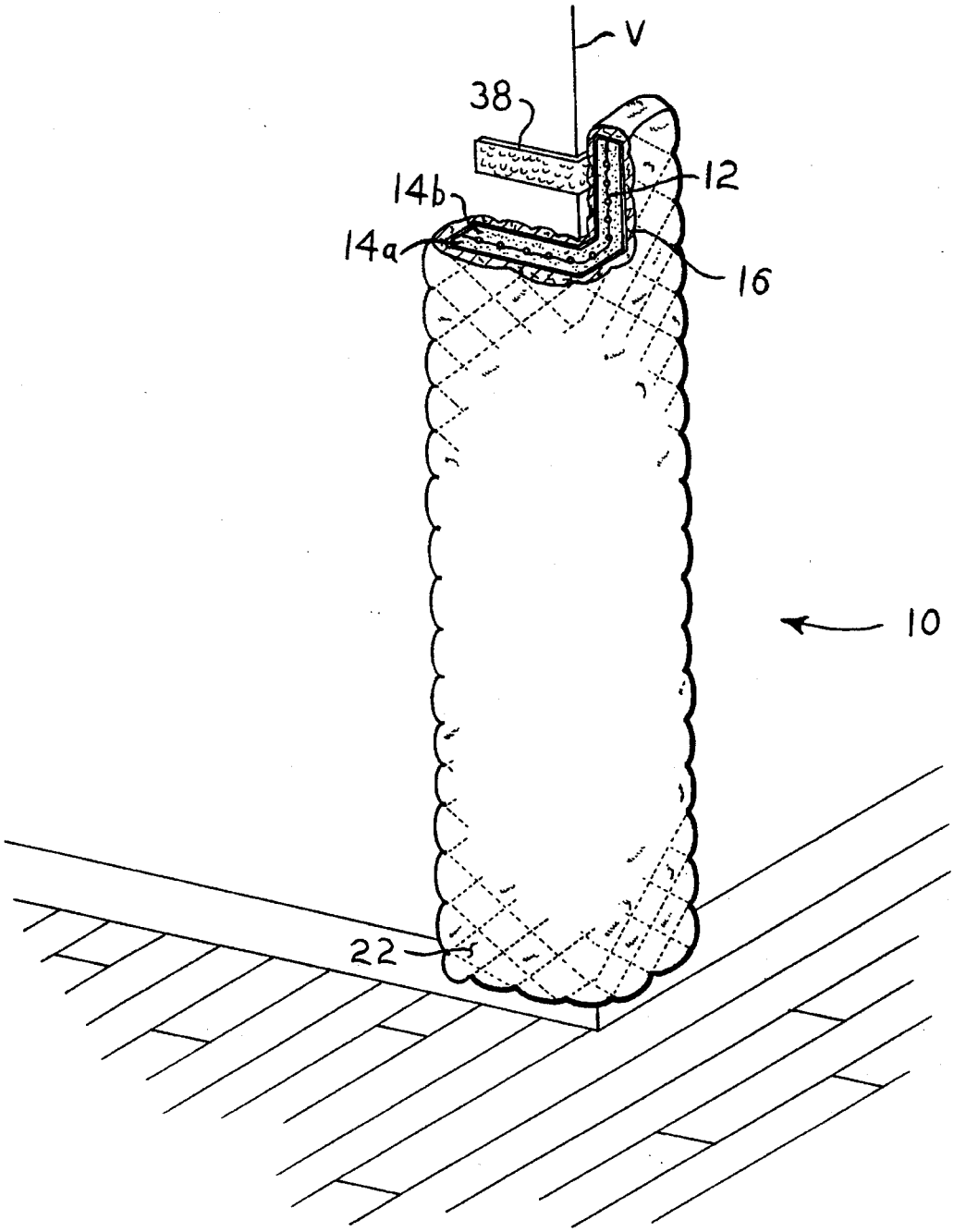
FIG. 2 is a perspective view of the present edge and corner guard showing an alternate use and attachment means.
Figure 4:
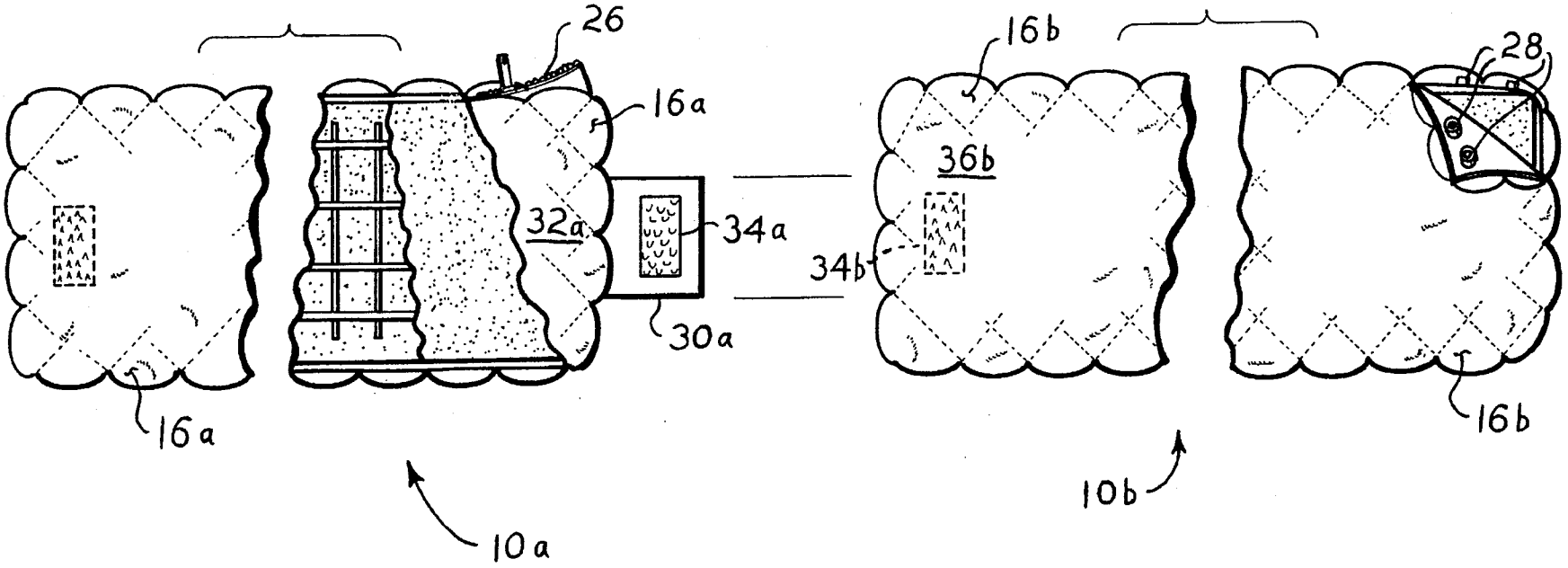
FIG. 4 is an exploded front view in section, showing further details of the construction and materials, as well as means providing for the removal of the covering envelope.

The outer envelope 16 may be formed as a sleeve with one closed end and then installed about the central core and padding sheets with the remaining open end then being permanently sewn shut, as indicated in FIG. 2 where a continuous outer envelope 16 is shown, with no openings provided therein. Alternatively, it may be desirable to provide an openable closure of some sort on one side or end of the cover 16, so it may be removed for laundering or cleaning as desired, or to change cover patterns, etc. In FIG. 3, mating hook and loop fastening material panels 24*a* and 24*b* are secured to mating edges of the envelope 16 along one side thereof, to provide an openable closure. In FIG. 4, additional alternatives are shown, with the edge and corner guard 10*a* on the left of the figure having a zipper closure 26 for the envelope 16*a* and the edge and corner guard 10*b* on the right having a snap fastener closure 28 for the corresponding envelope 16*b*. Other types of fastening means (buttons, etc.) may be used as desired.

FIG. 4 also discloses a means of securing multiple edge and corner guards of the present invention, together in series to cover an edge longer than the length of a single guard. In FIG. 4, the cover or envelope 16*a* of the edge and corner guard 10*a* to the left includes a tab 30*a* secured to the first end 32*a* thereof and extending therefrom, with the tab 30*a* including a first component 34*a* of hook and loop material thereon. The hook and loop material 34*a* mates with appropriate complementary hook and loop material 34*b*, secured to the opposite surface (as shown in hidden lines) of the second end 36*b* of the adjacent edge and corner guard 10*b*. It will be seen that several such edge and corner guards 10, 10*a*, and/or 10*b* may be secured together in abutting end-to-end fashion, by means of providing each with a tab 30 extending from the first end 32 with a hook and loop fastening portion 34*a* thereon, and a mating portion 34*b* on the opposite surface of the second end 36 of an adjacent edge and corner guard 10/10*a*/10*b*. The attachment tab 30 may be tucked behind the last edge and corner guard in the series so as to be out of sight, as in the corner guard 10*b* to the right side of FIG. 4.

Generally, the ability of the central core 12 to maintain whatever shape to which the edge and corner guard 10 is formed, provides for the securing of the guard 10 to any specific edge and corner combination to which it may be applied. However, in the case of vertical 90 degree convex edges, such as the edge V of FIG. 2, some additional means may be needed. In FIG. 2, a hook and loop fastener component 38 has been applied to the vertical edge V, in order to secure to a mating component (e.g., the portion 34*b* described in FIG. 4). Thus, the present edge and corner guard 10 may be secured to virtually any edge as required.

In summary, the present edge and corner guard 10/10*a*/10*b* in its various embodiments, will be seen to provide for greatly increased safety around the home, particularly in homes with smaller children and toddlers. Various shops and small businesses may also make valuable use of the present guard, both in protecting the general public and also employees of the shop or business. Oftentimes such shops and businesses are relatively cramped due to merchandise displays, columns and other internal structure, etc., and the present guard may be installed advantageously to preclude injury to both customers and employees.

The formability and low elasticity of the central core material 12, enables the guard to be bent and folded to the desired shape to conform to the outer contours of practically any edge or corner as desired, as shown in FIG. 3, and to maintain that conforming shape in order to grasp the edge or corner without need for additional securing means, as shown in FIG. 1. The outer cover material may be permanently installed, or alternatively removably installed for laundering and cleaning, by providing any one of various closure means thereon, as shown in FIGS. 3 and 4. Two or more of the guards may be installed in series with their ends abutting, by means of mating fastening means provided thereon, as shown in FIG. 4. Accordingly, the present guards may be used to cover or guard an edge of virtually any practicable length. With the addition of a single fastener component on a vertical edge, as shown in FIG. 2, the present guard may be easily secured thereto in order to preclude injury to persons or objects which inadvertently come in contact with such a vertical edge V. The applicability of the present guard will be seen to be virtually universal in such situations and environments.

It is to be understood that the present invention is not limited to the sole embodiments described above, but encompasses any and all embodiments within the scope of the following claims.

I claim:

1. An edge and corner guard comprising:

a central core of flexible material adapted to be bent and formed by hand and to retain any shape to which it is bent and formed, said central core of flexible material being a metal wire screen;

opposite first and second padding sheets of soft, resilient material secured to said metal wire screen and sandwiching said wire screen therebetween, said first and second padding sheets of resilient material being adhesively secured to one another through said metal wire screen, and;

a soft and flexible outer envelope surrounding said first and second sheets of material, whereby;

said edge and corner guard is bent and formed to conform to an edge and corner object to which said edge and corner guard is to be applied and is placed over the edge and corner object, whereupon said edge and corner guard remains secured to the edge and corner object by means of said flexible central core of material being bent and formed to grasp the edge and corner object, with said central core of material thereby also holding said first and second padding sheets of resilient material and said outer envelope in position about the edge and corner object.

2. The edge and corner guard of claim 1 wherein:

said metal wire screen is non-woven poultry wire.

3. The edge and corner guard of claim 1 wherein:

said first and second padding sheets of resilient material are open cell foam material.

4. The edge and corner guard of claim 1 wherein:

said first and second padding sheets of resilient material are closed cell foam material.

5. The edge and corner guard of claim 1 wherein:

said central core of material includes a periphery therearound and said first and second padding sheets each include a larger periphery therearound than said central core periphery, and said central core of material is centrally placed between said first and second padding sheets of material with each said periphery of said first and second padding sheets of material being congruent and extending evenly beyond said periphery of said central core of material.

6. The edge and corner guard of claim 1 wherein:

said outer envelope is permanently secured about said first and second padding sheets of resilient material and said central core.

7. The edge and corner guard of claim 1 wherein:

said outer envelope includes openable closure means therein and is removably secured about said first and second padding sheets of resilient material and said central core.

8. The edge and corner guard of claim 7 wherein:

said outer envelope closure means comprises mating panels of hook and loop fastener material.

9. The edge and corner guard of claim 7 wherein:

said outer envelope closure means is a zipper.

10. The edge and corner guard of claim 7 wherein:

said outer envelope closure means is a plurality of snap fasteners.

11. The edge and corner guard of claim 1 wherein:

said outer envelope is fabric.

12. The edge and corner guard of claim 11 wherein:

said fabric outer envelope is quilted.

13. The edge and corner guard of claim 11 wherein:

at least said fabric outer envelope is flame retardant.

14. The edge and corner guard of claim 1 wherein:

said outer envelope includes a first end having a tab extending therefrom with said tab including first means providing for the attachment of said edge and corner guard to another article, and an opposite second end including mating second means providing for the attachment of said second end to said first attachment means of said tab.

15. The edge and corner guard of claim 14 wherein:

said first and second attachment means comprise mating hook and loop fastening material.

* * * * *